US006224292B1

(12) United States Patent
Akalin

(10) Patent No.: US 6,224,292 B1
(45) Date of Patent: May 1, 2001

(54) CATCH BASIN INSTALLATION SYSTEM AND METHOD

(76) Inventor: Coskun Akalin, 274 Columbia St., Brookville, OH (US) 45309

( * ) Notice: Subject to any disclaimer, the term of this patent is extended or adjusted under 35 U.S.C. 154(b) by 0 days.

(21) Appl. No.: 09/334,552

(22) Filed: Jun. 16, 1999

(51) Int. Cl.[7] ..... E02D 29/12
(52) U.S. Cl. ..... 404/26; 52/20
(58) Field of Search ..... 404/25, 26; 52/20; 30/92; 83/438, 829

(56) References Cited

U.S. PATENT DOCUMENTS

| | | | | |
|---|---|---|---|---|
| 3,893,919 | | 7/1975 | Flegel et al. . | |
| 4,197,031 | | 4/1980 | Hild . | |
| 4,273,466 | | 6/1981 | Trahan, Sr. et al. . | |
| 4,345,376 | * | 8/1982 | Benson et al. | 30/96 |
| 4,505,814 | | 3/1985 | Marshall . | |
| 4,540,310 | * | 9/1985 | Ditcher et al. | 404/25 |
| 4,709,723 | | 12/1987 | Sidaway et al. . | |
| 5,386,669 | | 2/1995 | Almeida . | |
| 5,813,797 | | 9/1998 | Pendleton et al. . | |
| 5,934,820 | * | 8/1999 | Hinkle | 404/26 |

* cited by examiner

*Primary Examiner*—David Bagnell
*Assistant Examiner*—Jennifer R. Dougherty
(74) *Attorney, Agent, or Firm*—Jacox, Meckstroth & Jenkins

(57) ABSTRACT

The invention concerns a catch basin installation system and method wherein a catch basin is situated below ground and has a neck extending substantially vertically upward through the ground to provide access to subterranean sewage or drain lines. During installation, an adjustable collar is situated around the neck of the basin at substantially ground level or some other predetermined or desired level. The portion of the basin neck extending above the tin adjustable collar is removed by using the adjustable collar as a guide. The system and method enable a user to quickly set the catch basin so that its top edge is at the desired or predetermined level (such as ground level) so that, for example, when a grate is situated on an end of the vertically-extending neck, the grate is situated at substantially ground level.

26 Claims, 2 Drawing Sheets

CATCH BASIN INSTALLATION SYSTEM AND METHOD

BACKGROUND OF THE INVENTION

1. Field of the Invention

This invention relates to a system and method for installing a catch basin, and more particularly, a system and method for facilitating the removal of a portion of the basin such that the top edge of a basin or vertical extension and grate lie in a plane which is substantially co-planar with a surface of the ground.

2. Description of the Related Art

Modern sewage and drain systems oftentimes include catch basins for directing fluid, such as rain water, sewage and the like. The basins typically comprise a sewer cover and a vertical connector line which provides access to subterranean lines which are typically networked beneath ground level. A manhole is essentially a vertical passageway, typically beginning at ground level or at or near the street surface and extending downward into the ground into communication with the subterranean lines. The lines may be discharged directly into rivers or streams, or for sewage, to a sewage treatment facility so that waste and drainage may be properly processed.

Typically, manholes are formed through various construction techniques of bricks, tiles or concrete blocks bound together with cement mortar. Pre-cast and cast-in-place concrete manholes are also common.

The prior art reflects various types of devices for adjusting the position of the manholes or drain cover such that it is situated at substantially ground level. Without such devices, the manhole or drain cover may extend an undesirable length above the ground or too far below the ground, making access difficult and/or inhibiting or interfering with the operation of the drain or sewage system.

For example, U.S. Pat. No. 5,505,814 to Marshall discloses a roof drain receptacle for attachment to an upper surface of a roof deck for supporting the drain body at adjustable variable heights above the roof deck. Likewise, U.S. Pat. No. 4,197,031 discloses a vertically adjustable manhole cover. These references, as well as other known prior art, have numerous drawbacks, such as requiring multiple component parts and numerous steps and adjustments needed for proper assembly.

What is needed, therefore, is a simple system and method for situating a catch basin or line in the ground wherein the vertical component of the line or basin can be quickly adjusted so that its end is at ground level.

SUMMARY OF THE INVENTION

It is, therefore, an object of the invention to provide a system and method for installing a catch basin or similar drain line such that the end of the basin is at a predetermined or desired level, such as ground level.

Another object of the invention is to provide a system and method that reduces the need for numerous assemblies and components.

Still another object of the invention is to provide a system and method which, when used or followed repeatedly, requires a relatively small amount of skill and utilizes only a few installation steps.

In one aspect, a catch basin installation system comprises a basin defining a conduit through which fluid may pass, an adjustable collar for positioning around the basin, the adjustable collar providing a guide for removing an above-ground portion of the basin so that an opening of the basin is substantially co-planar with the ground, and a grate for situating in the opening.

In another aspect a catch basin installation system comprises a basin defining a conduit through which fluid may pass, a guide on the basin for identifying an above-ground portion of the basin and a below-ground portion of the basin, the guide facilitating removal of the above-ground portion of the basin, and a grate for situating on the edge.

In still another aspect, a method for installing a catch basin comprises the steps of placing the catch basin in the ground, situating a collar around a portion of the catch basin at substantially ground level, and using the collar as a guide to removing an above-ground portion of the catch basin so that a top edge of the catch basin is substantially co-planar with ground level.

In yet another aspect a catch basin installation method comprising the steps of providing a basin defining a conduit through which fluid may pass, providing a guide on the basin for identifying an above-ground portion of the basin and a below-ground portion of the basin so that the above-ground portion of the basin may be easily identified and removed, and providing a grate for situating on the edge.

In a further aspect an adjustable guide for situating on a portion of a line, comprises a guide having an opening which generally complements the shape of the catch basin and at least one fastener for adjustably securing the guide to the catch basin, the guide providing a guide surface for guiding a cutting tool to cut the basin, thereby leaving a top edge of the basin substantially co-planar with the ground surface.

These and other objects and advantages of the invention will be apparent from the following description, the accompanying drawings and the appended claims.

BRIEF DESCRIPTION OF ACCOMPANYING DRAWINGS

DETAILED DESCRIPTION OF THE INVENTION

Figure 1:
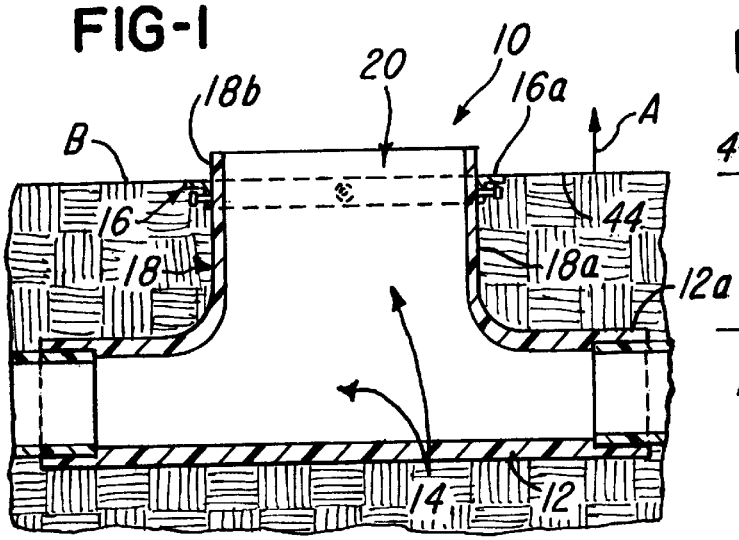
FIG. 1 is a fragmentary sectional view showing a catch basin having a portion of a neck extending above the ground prior to removal.
Figure 2:
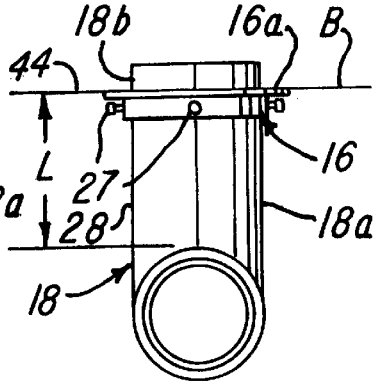
FIG. 2 is an end view of the T-shaped catch basin shown in FIG. 1.
Figure 6:
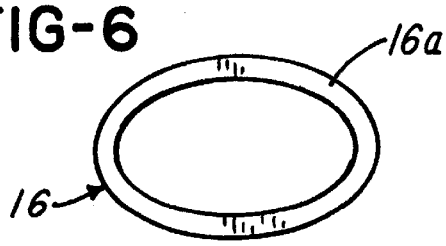
FIG. 6 is a top view of the collar, showing a shape which complements the shape of the opening of the catch basin.
Figure 7:
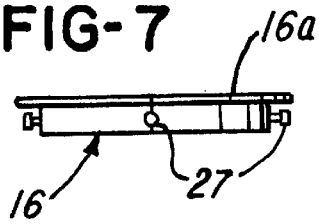
FIG. 7 is a side view of the adjustable collar shown in FIG. 6, showing the set screws used for securing the adjustable collar to the neck portion of the basin.

Referring now to FIG. 1, a catch basin installation system 10 is shown. The installation system 10 comprises a basin 12 defining a T-shaped conduit 14 through which fluid, such as sewage, water or the like (not shown), may pass. The basin 12 has a horizontal portion 12*a* which is coupled to the subterranean lines (not shown) and a vertical or neck portion 18 for permitting access to the subterranean lines from, for example, above ground. The installation system 10 further comprises an adjustable collar 16 for positioning around a vertical or neck portion 18 of the basin 12. Ultimately, the top portion is removed as described herein so that an opening 20 defined by a top edge 22 of the basin 12 is substantially co-planar with a ground surface or level 44. Note that the neck or vertical portion 18 is substantially perpendicular to the ground level 44, and it has end or top edge 22 (FIGS. 6 and 7) capable of supporting a grate 26. The grate 26 (FIG. 2) may be situated on the top edge 22 in the manner described later herein.

Figure 3:
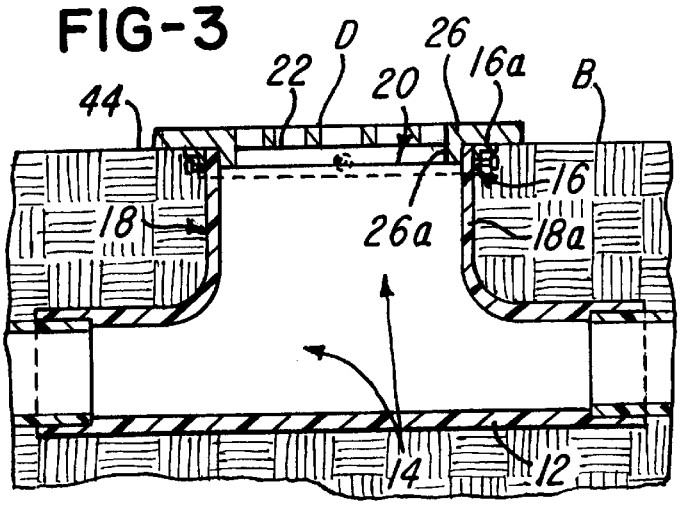
FIG. 3 is a view similar to FIG. 2 after a portion of the neck, i.e., the portion above the adjustable collar has been removed.
Figure 4:
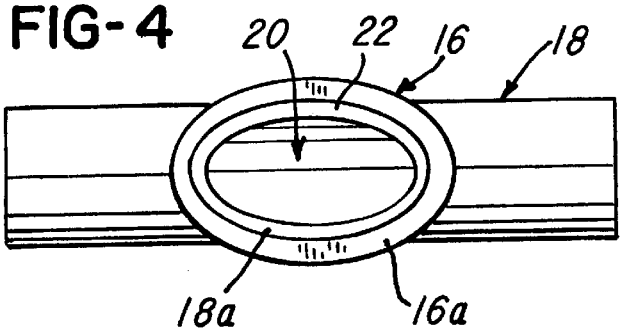
FIG. 4 is a top view of the catch basin and adjustable collar shown in FIG. 3.

During installation, the basin 12 is situated in the ground such that a portion 18*a* of the neck 18 is situated below ground level, while another portion 18*b* of the neck 18 is situated above ground level 44. In the embodiment described herein, the collar 16 is situated or slid onto or around the neck 18, as best illustrated in FIG. 3. The collar 16 comprises a shape which complements the shape of the neck 18, as best illustrated in FIG. 4.

In the embodiment being described, the invention may be used with T-shaped PCV tubing having generally circular passageway apertures. It has been found that providing a basin 12 having an oval or elliptical-shaped aperture, as shown in FIG. 4, facilitates entering into and out of the opening 20. As best illustrated in FIGS. 1 and 3, the adjustable collar 16 comprises at least one or a plurality of set screws 27 (FIGS. 3 and 7) for fastening the collar 16 to the outer surface 28 (FIG. 2) of basin 12. As mentioned later herein, the collar is generally L-shaped in cross-section, and once fastened to the conduit neck 18, the portion 18*b* extending above the collar (in the direction of arrow A in FIG. 1) may be removed, for example, by sawing the portion 18*b* in a plane, indicated by line B in FIG. 3, so that the top edge 22 lies in a plane which is substantially coplanar with both the surface 16*a* of adjustable collar 16, and both the surface 16*a* and edge 22 are at substantially ground level.

Advantageously, this system provides a convenient and very quick means and system for reducing the length L in FIG. 3 so that the top edge 22 of the neck 18 is at substantially ground level. This facilitates, for example, providing a basin 12 having a common neck length which can be quickly reduced in length to a desired level (such as ground level), without the need for special brackets or adjusting caps.

In the embodiment being described, the basin 12 is a typical T-shaped basin comprised of PVC tubing, and the adjustable collar 16 is made of cast iron. A methodology for installing and/or utilizing the catch basin installation system will now described relative to FIG. 6.

Figure 8:
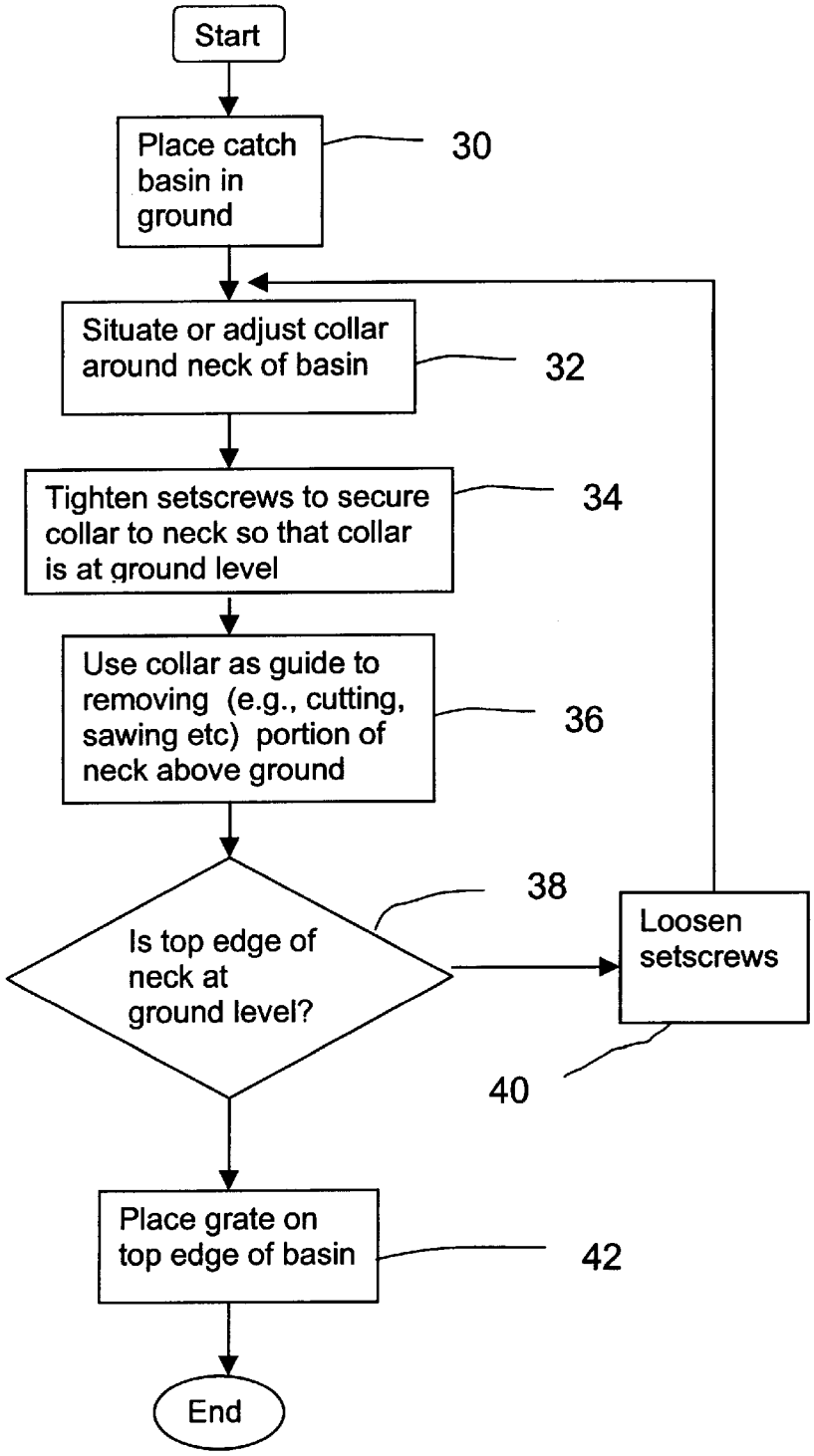
FIG. 8 is a schematic view of a method of installation in accordance with one embodiment of the invention.

The method begins at block 30 (FIG. 8) wherein the T-shaped catch basin or such other suitable shape as may be desired is placed in the ground so that the neck 18 extends some distance above the ground (as shown in FIG. 1). At block 32, the adjustable collar 16 is situated on the neck and the various set screws 27 are tightened (block 34) such that the collar 16 is situated at substantially ground level, as best shown in FIGS. 1 and 3.

At block 36, the top surface 16*a* of collar 16 is used as a guide to remove the portion 18*a* of neck 18 which extends above the collar 16 and above ground level. Various types of cutting tools, such as a saw, knife, flame or other suitable means for detaching the portion 18*b* from 18*a* may be used.

At decision block 38, it is determined whether the top edge 22 of neck 18 is at ground level. If it is not, then the method proceeds to block 40 wherein the set screws 27 are loosened and then the routine proceeds to block 32 to again adjust the position of collar 16 in the manner described earlier. If the decision at decision block 38 is yes, then the routine proceeds to block 42 where grate 26 may be placed on the edge 22. Additionally, the area outside of and around the neck 18 and below the collar 16 may be back filled so that the grate 26 and collar 16 appear "flush" or level with the ground. Alternatively, the collar 16 may be removed after it has been used as a guide. Advantageously, this system and method provides means for quickly installing a catch basin such that the grate and top surface of the basin lie in a plane which is substantially co-planar or "flush" with the ground.

Figure 5:
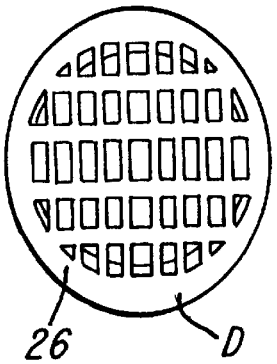
FIG. 5 is a top view of the grate which maybe situated on an end of the neck.

In the embodiment shown, the dimension of the length L is about 24 inches. The height (as viewed in FIG. 5) of the grate 26 is about 24 inches. The grate 26 substantially corresponds or complements the dimensions and shape of the edge 22 of neck 18 defining the opening 20, so that the grate 26 has a bottom flange 26*a* (FIG. 3) recessed within edge 22, as shown in FIG. 3 so that the top edge 22*b* becomes seated on edge 22 as shown.

The neck 18 may be elliptical as shown to permit easy access (e.g., for cleaning conduit 12). Also, although the neck 18 defines opening 20 which is elliptical, it could be any suitable or desired shape, such as circular, square, polygonal or the like. The diameter of the inlet and outlet conduits defining the basin 12 could be any desired diameter or dimension, such as 6", 8", 12", 14", 16", 20", etc.

While the method herein described, and the form of apparatus for carrying this method into effect, constitute preferred embodiments of this invention, it is to be understood that the invention is not limited to this precise method and form of apparatus. For example, the embodiment shown illustrates the use of the invention in a subterranean sewage or drain system, but the invention may be used in other environments such as floor or roof drains, roof and wall ventilation and the like. Also, changes may be made in either the method or form of the invention without departing from the scope of the invention, which is defined in the appended claims.

What is claimed is:

1. A catch basin installation system comprising:

a basin defining a conduit through which fluid may pass;

an adjustable collar for positioning around said basin, said adjustable collar providing a guide for removing an above-ground portion of said basin so that an opening of said basin is substantially co-planar with the ground, said adjustable collar providing said guide after said adjustable collar is situated on said basin; and a grate for situating in said opening.

2. The catch basin installation system as recited in claim 1 wherein said adjustable collar comprises at least one set screw for fastening said adjustable collar to said basin.

3. The catch basin installation system as recited in claim 1 wherein said adjustable collar defines a shape which complements the shape of said basin.

4. The catch basin installation system as recited in claim 3 wherein said collar shape is substantially elliptical.

5. The catch basin installation system as recited in claim 3 wherein said collar shape is circular.

6. The catch basin installation system as recited in claim 1 wherein said basin is T-shaped.

7. A catch basin installation system comprising:

a basin defining a conduit through which fluid may pass;

a guide on said basin for identifying an above-ground portion of said basin and a below-ground portion of said basin, said guide facilitating removal of said above-ground portion of said basin, said guide identifying said above-ground portion after said guide is situated on said basin; and a grate for situating on an edge.

8. The catch basin installation system as recited in claim 7 wherein said guide comprises an adjustable collar for situating around a portion of said basin, said adjustable collar being adjustably secured to said basin to provide said guide.

9. The catch basin installation system as recited in claim 8 wherein said adjustable collar comprises at least one set screw for fastening said adjustable collar to said basin.

10. The catch basin installation system as recited in claim 8 wherein said adjustable collar defines a shape which complements the shape of said basin.

11. The catch basin installation system as recited in claim 10 wherein said collar shape is substantially elliptical.

12. The catch basin installation system as recited in claim 10 wherein said collar shape is circular.

13. A method for installing a catch basin comprising the steps of:

placing the catch basin in the ground;

situating a collar around a portion of the catch basin at substantially ground level; and using said collar as a guide to removing an above-ground portion of the catch basin so that a top edge of said catch basin is substantially co-planar with said ground level, said collar providing said guide after said collar is situated on said basin.

14. The method as recited in claim 13 wherein said situating step further comprises the step of:

fastening said collar to said catch basin.

15. The method as recited in claim 13 wherein said situating step further comprises the step of:

using a collar which is L-shaped in cross section.

16. The method as recited in claim 13 wherein said collar comprises a plurality of set screws, said method further comprises the step of:

tightening said set screws so that a portion of said collar lies in a plane which is co-planar with said ground level.

17. A catch basin installation method comprising the steps of:

providing a basin defining a conduit through which fluid may pass;

providing a guide on said basin for identifying an above-ground portion of said basin and a below-ground portion of said basin so that said above-ground portion of said basin may be easily identified and removed, said guide identifying said above-ground portion and said below-ground portion after said guide is situated on said basin; and providing a grate for situating on an edge.

18. The catch basin installation method as recited in claim 17 wherein said providing a guide step further comprises the step of:

providing a guide having an adjustable collar for situating around a portion of said basin, said adjustable collar being adjustably secured to said basin to provide said guide.

19. The catch basin installation method as recited in claim 18 wherein said providing a guide step further comprises the step of:

providing an adjustable collar comprising at least one set screw for fastening said adjustable collar to said basin.

20. The catch basin installation method as recited in claim 18 wherein said method further comprises the step of:

providing an adjustable collar defining a shape which complements the shape of said basin.

21. The catch basin installation method as recited in claim 20 wherein said collar shape is substantially elliptical.

22. The catch basin installation method as recited in claim 20 wherein said collar shape is circular.

23. An adjustable guide for situating on a portion of a catch basin, comprising:

a guide having an opening which generally complements the shape of the catch basin; and at least one fastener for adjustably securing said guide to the catch basin;

said guide providing a guide surface for guiding a cutting tool to cut said basin, thereby leaving a top edge of said basin substantially co-planar with the guide surface, an adjustable collar providing said guide after said guide is situated on said basin.

24. The adjustable guide as recited in claim 23, wherein said guide is generally L-shaped in cross section.

25. The adjustable guide as recited in claim 23, wherein said guide surface lies in a plane which is substantially co-planar with a top of a ground.

26. The adjustable guide as recited in claim 23, wherein said basin defines a shape which complements a cross-sectional shape of a portion of said basin.

* * * * *